US011081782B2

(12) United States Patent
Chang et al.

(10) Patent No.: US 11,081,782 B2
(45) Date of Patent: Aug. 3, 2021

(54) THREE-DIMENSIONAL ANTENNA ELEMENT

(71) Applicant: ASUSTeK COMPUTER INC., Taipei (TW)

(72) Inventors: Wei-Hsuan Chang, Taipei (TW); Fang-Hsien Chu, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 104 days.

(21) Appl. No.: 16/669,749

(22) Filed: Oct. 31, 2019

(65) Prior Publication Data

US 2020/0144707 A1 May 7, 2020

(30) Foreign Application Priority Data

Nov. 7, 2018 (TW) ..... 107139548

(51) Int. Cl.

| | |
|---|---|
| ***H01Q 1/38*** | (2006.01) |
| ***H01Q 9/04*** | (2006.01) |
| ***H01Q 1/36*** | (2006.01) |
| ***H01Q 1/24*** | (2006.01) |

(52) U.S. Cl.

CPC ..... *H01Q 1/36* (2013.01); *H01Q 1/243* (2013.01)

(58) Field of Classification Search

CPC ..... H01Q 1/243; H01Q 1/24; H01Q 1/36; H01Q 1/38; H01Q 1/48; H01Q 9/04

See application file for complete search history.

(56) References Cited

U.S. PATENT DOCUMENTS

| | | | | |
|---|---|---|---|---|
| 4,379,296 | A * | 4/1983 | Farrar | H01Q 3/247 343/700 MS |
| 7,002,519 | B2 * | 2/2006 | Wang | H01Q 1/243 343/700 MS |
| 7,609,209 | B2 * | 10/2009 | Shih | H01Q 1/243 343/700 MS |
| 7,916,086 | B2 * | 3/2011 | Koskiniemi | H01Q 1/38 343/700 MS |
| 8,723,739 | B2 * | 5/2014 | Liu | H01Q 9/0421 343/702 |
| 8,761,699 | B2 * | 6/2014 | Li | H01Q 9/285 455/129 |
| 10,069,199 | B2 * | 9/2018 | Chen | H01Q 1/38 |
| 10,797,376 | B2 * | 10/2020 | Tu | H01Q 7/00 |

FOREIGN PATENT DOCUMENTS

| | | |
|---|---|---|
| CN | 204179208 U | 2/2015 |
| CN | 205050985 U | 2/2016 |
| EP | 0814535 B1 | 7/2009 |

* cited by examiner

*Primary Examiner* — Tho G Phan

(74) *Attorney, Agent, or Firm* — McClure, Qualey & Rodack, LLP

(57) ABSTRACT

A three-dimensional antenna element is provided. The three-dimensional antenna element is configured to be disposed on a surface of a conductive substrate, and includes a dielectric base, a first radiation part, a second radiation part, a third radiation part, a fourth radiation part, a first shorting element, and a second shorting element. The dielectric base includes a first plane and a second plane, where the second plane includes a first side and a second side, the first side is opposite to the second side and configured to be joined to the first plane, and the second side is configured to be joined to the surface of the conductive substrate. A signal feed-in point is coupled between the first radiation part and the second radiation part.

12 Claims, 8 Drawing Sheets

THREE-DIMENSIONAL ANTENNA ELEMENT

CROSS-REFERENCE TO RELATED APPLICATION

This application claims the priority benefit of Taiwan Application Serial No. 107139548, filed on Nov. 7, 2018. The entirety of the above-mentioned patent application is hereby incorporated by reference herein and made a part of specification.

BACKGROUND OF THE INVENTION

Field of the Invention

The disclosure relates to an antenna element, and, more particularly, to a three-dimensional antenna element having a stereoscopic radiation pattern.

Description of the Related Art

An antenna of a wireless communication product is usually configured in a clearance area around a screen. However, a wireless communication product designed with a full screen has become mainstream. Therefore, the space for antenna in a frame around the screen of the wireless communication product becomes very narrow. Furthermore, a metal body is currently used in wireless communication products. Therefore, a clearance area for configure antennas in the wireless communication products is greatly reduced. In addition, wireless communication radio frequency signals are transmitted to the wireless communication product in a plurality of different signal paths, so that the wireless communication product needs to use an antenna having a plurality of radiation directions.

BRIEF SUMMARY OF THE INVENTION

According to the aspect of the disclosure, a three-dimensional antenna element is provided. The three-dimensional antenna element disposed on a surface of a conductive substrate comprises a dielectric base, a first radiation part, a second radiation part, a third radiation part, a fourth radiation part, a first shorting element, and a second shorting element. The dielectric base comprises a first plane and a second plane. The second plane comprises a first side and a second side. The second side is opposite to the first side, the first side is connected to the first plane, and the second side is connected to the surface of the conductive substrate. The second radiation part, wherein a signal feed-in point is coupled between the first radiation part and the second radiation part. The first radiation part, the second radiation part, and the third radiation part are disposed on the first plane and are connected to the first side of the second plane. The fourth radiation part is disposed on the first plane and coupled to the third radiation part. The first shorting element is disposed on the second plane and coupled between the second radiation part and the surface of the conductive substrate. The second shorting element is disposed on the second plane and coupled between the third radiation part and the surface of the conductive substrate.

BRIEF DESCRIPTION OF THE DRAWINGS

To make the foregoing and other objectives, features, advantages, and embodiments of the disclosure more comprehensible, descriptions of the accompanying drawings are as follows.

DETAILED DESCRIPTION OF THE EMBODIMENTS

Embodiments of the disclosure will be described below with reference to the accompanying drawings. In the accompanying drawings, same or similar symbols represent same or similar elements or method processes.

Figure 1:
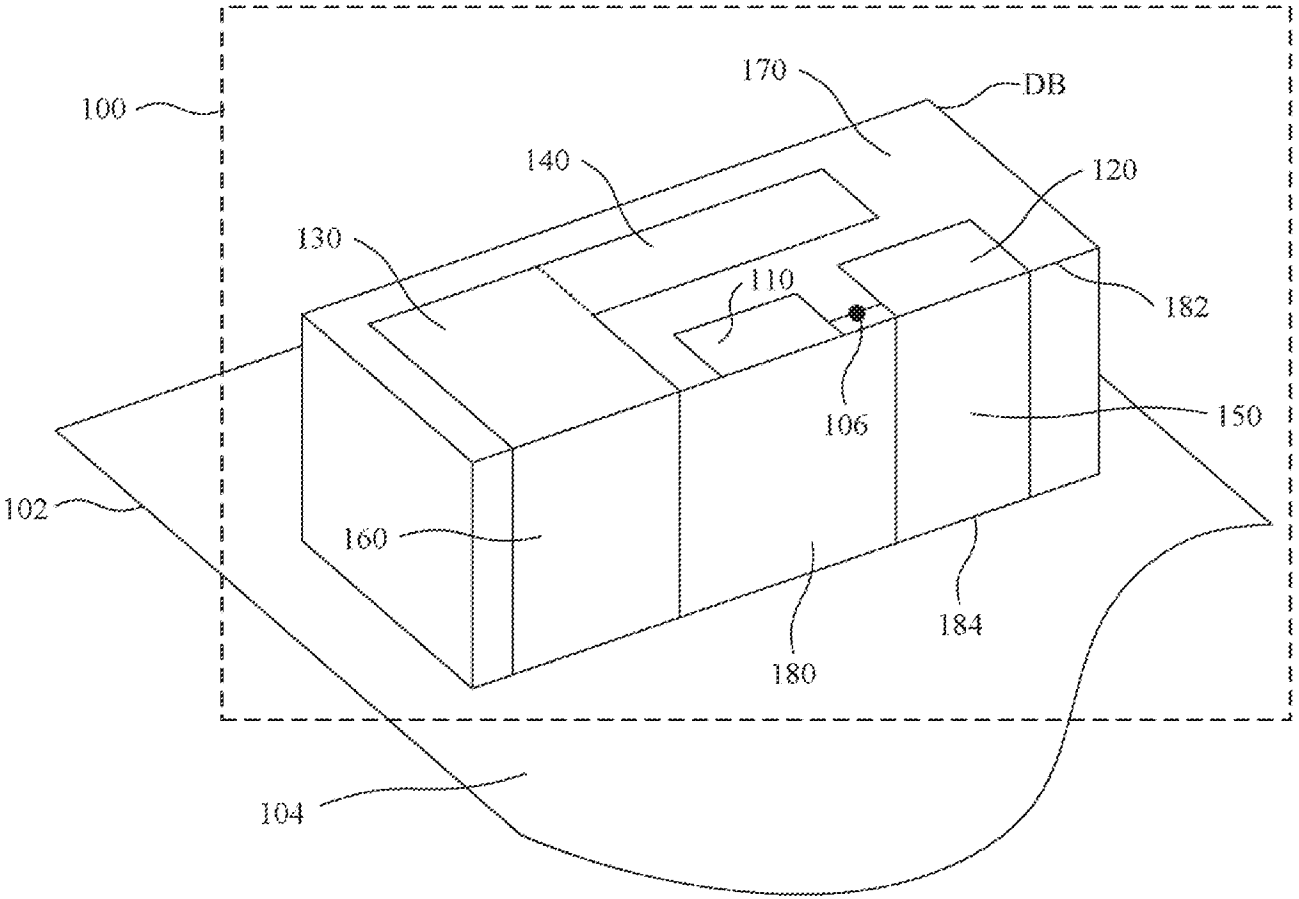
FIG. 1 is a schematic diagram showing a simplified three-dimensional antenna element according to an embodiment of the disclosure.

Refer to FIG. 1. A three-dimensional antenna element 100 includes a dielectric base DB, a first radiation part 110, a second radiation part 120, a third radiation part 130, a fourth radiation part 140, a first shorting element 150, and a second shorting element 160. The dielectric base DB includes a first plane 170 and a second plane 180. The second plane 180 includes a first side 182 and a second side 184. The first side 182 is opposite to the second side 184. The first side 182 of the second plane 180 is connected to the first plane 170. The second side 184 is connected to a surface 104 of a conductive substrate 102. The three-dimensional antenna element 100 allows the conductive substrate 102 to be a part of a resonance path, so that a signal is transmitted or received through the conductive substrate 102 to improve radiation efficiency.

Actually, the conductive substrate 102 is a part of a metal case of an electronic device, such as a mobile phone, a tablet computer, or a notebook computer, that works in wireless communication environment. In the disclosure, the conductive substrate 102 is only a schematic drawing. A size, a location, and a shape of the conductive substrate 102 are adjusted based on different designs. In an embodiment, the dielectric base DB is a glass fiber or another proper insulation material.

The first radiation part 110, the second radiation part 120, the third radiation part 130, and the fourth radiation part 140 are all disposed on the first plane 170. The first radiation part 110 and the second radiation part 120 are connected to the first side 182 of the second plane 180. A signal feed-in point 106 is coupled between the first radiation part 110 and the second radiation part 120. In an embodiment, the signal feed-in point 106 receives a radio frequency signal from a radio frequency transceiver (not shown in FIG. 1). The first radiation part 110 extends from the signal feed-in point 106 to the third radiation part 130 along the first side 182. The second radiation part 120 extends from the signal feed-in point 106 to a direction far from the third radiation part 130 along the first side 182.

The third radiation part 130 includes a first end and a second end. The first end is opposite to the second end. The first end of the third radiation part 130 is coupled to the fourth radiation part 140. The second end of the third radiation part 130 is connected to the first side 182 of the second plane 180. The fourth radiation part 140 extends from the first end of the third radiation part 130 to a direction far from the third radiation part 130. In addition, the fourth radiation part 140 is in L-shape connection with the third radiation part 130.

In other words, the first radiation part 110, the second radiation part 120, the fourth radiation part 140, and the first side 182 of the second plane 180 are parallel to each other. The third radiation part 130 is perpendicular to the first side 182 of the second plane 180.

The first shorting element 150 and the second shorting element 160 are disposed on the second plane 180. The first shorting element 150 is coupled between the second radiation part 120 and the surface 104 of the conductive substrate 102. The second shorting element 160 is coupled between the second end of the third radiation part 130 and the surface 104 of the conductive substrate 102. Because the first shorting element 150 couples the second radiation part 120 and the surface 104 of the conductive substrate 102 and the second shorting element 160 couples the third radiation part 130 and the surface 104 of the conductive substrate 102, a surface current of the surface 104 of the conductive substrate 102 is activated, and the conductive substrate 102 becomes a part of the resonance path.

Figure 2:
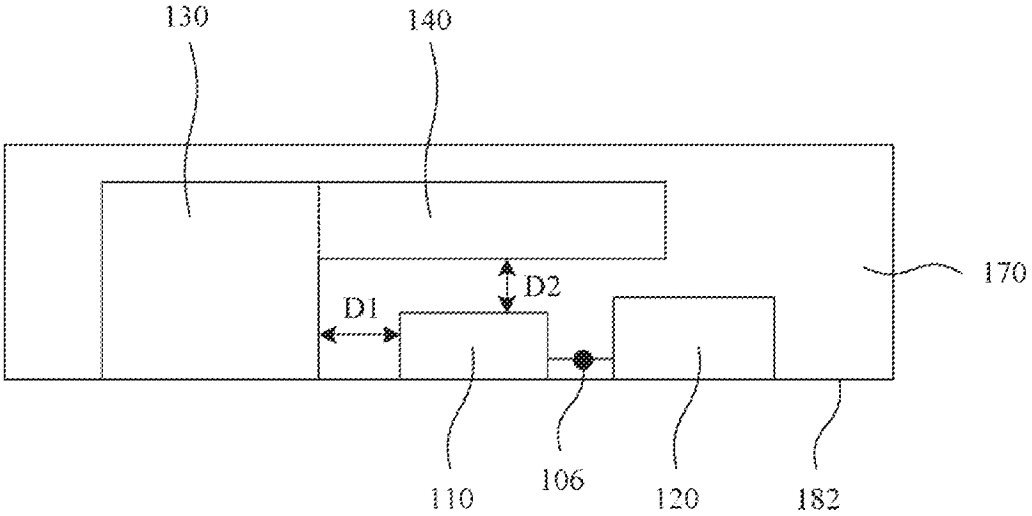
FIG. 2 is a top view showing the simplified three-dimensional antenna element in FIG. 1.

In addition, refer to FIG. 2. There is a first distance D1 between the first radiation part 110 and the third radiation part 130. There is a second distance D2 between the first radiation part 110 and the fourth radiation part 140. The second radiation part 120, the third radiation part 130, the fourth radiation part 140, and the first side 182 of the second plane 180 surround the first radiation part 110. In an embodiment, the first distance D1 is 0.5 mm to 2 mm, and the second distance D2 is 0.5 mm to 4 mm.

Actually, a plurality of radiation parts and shorting elements of the three-dimensional antenna element 100 is respectively made of a conductive material and then combined to each other. Alternatively, the plurality of radiation parts and shorting elements is directly made by punching or cutting an integrally shaped metal sheet, to reduce production complexity and costs and improve a production speed and a yield rate.

In an embodiment, the first plane 170 is parallel to the conductive substrate 102, and the second plane 180 is perpendicular to the first plane 170 and the conductive substrate 102. Therefore, the first shorting element 150 and the second shorting element 160 are perpendicular to the first plane 170 and the conductive substrate 102.

Figure 3:
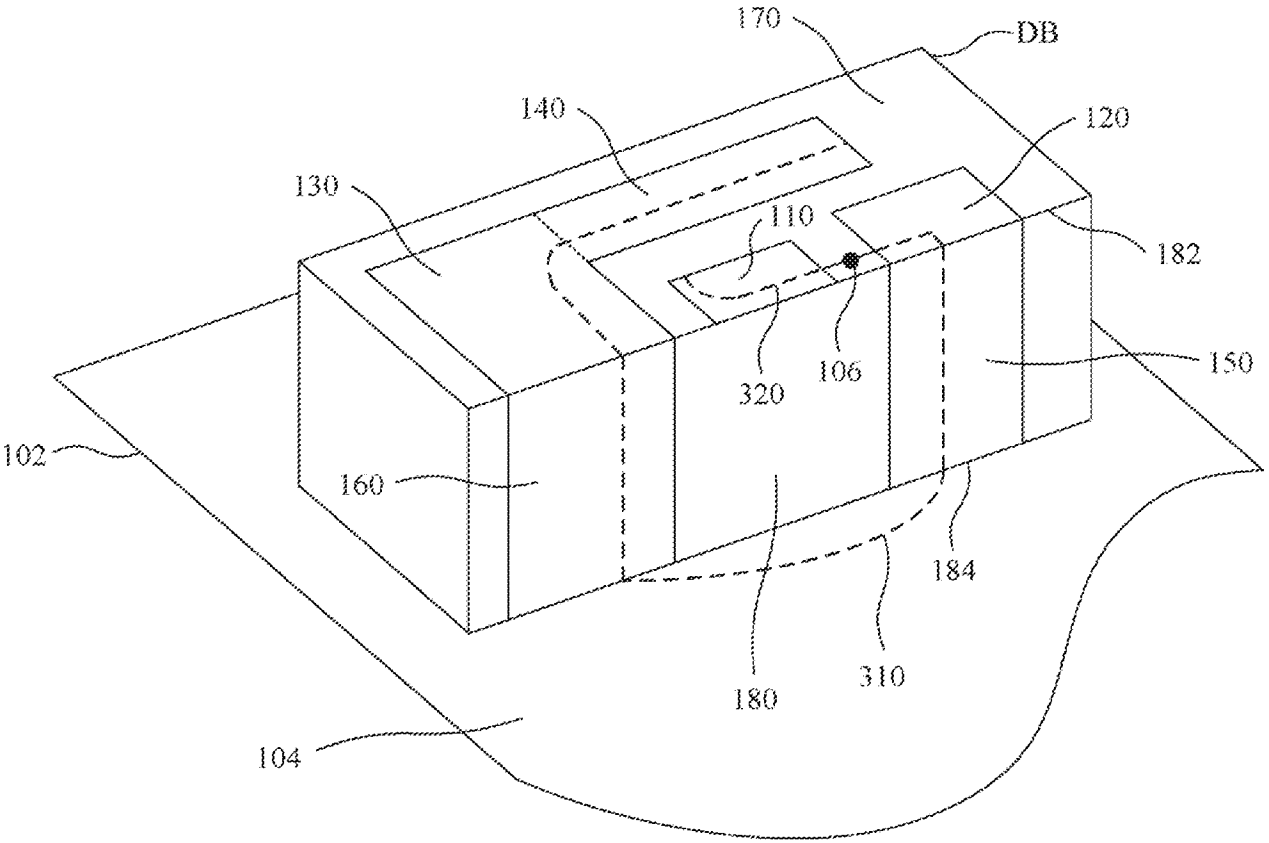
FIG. 3 is a schematic diagram showing a simplified equivalent current path of the three-dimensional antenna element in FIG. 1.

Refer to FIG. 3. When the signal feed-in point 106 receives the radio frequency signal, the three-dimensional antenna element 100 generates a first equivalent current path 310 and a second equivalent current path 320. In an embodiment, the first equivalent current path 310 extends from the signal feed-in point 106 to the fourth radiation part 140 by passing through the second radiation part 120, the first shorting element 150, the surface 104, the second shorting element 160, and the third radiation part 130 in sequence. The second equivalent current path 320 is located in the first radiation part 110. Energy of the radio frequency signal is transmitted from the signal feed-in point 106 to the fourth radiation part 140 along the first equivalent current path 310, and then energy of the radio frequency signal is transmitted to the first radiation part 110 in a coupling manner. Finally, energy of the radio frequency signal returns to the signal feed-in point 106 along the second equivalent current path 320.

It should be noted that because a part of the first equivalent current path 310 is located on the conductive substrate 102, the conductive substrate 102 is a part of a resonance structure of the three-dimensional antenna element 100. Therefore, the three-dimensional antenna element 100 uses the conductive substrate 102 to receive and transmit a signal, to improve communication quality.

In addition, the first shorting element 150 and the second shorting element 160 are used to adjust a length of the first equivalent current path 310. A resonance frequency of the three-dimensional antenna element 100 is in negative correlation with the length of the first equivalent current path 310. Therefore, by adjusting a length, a shape, and/or a distance of the first shorting element 150 and the second shorting element 160, the resonance frequency of the three-dimensional antenna element 100 is determined.

In addition, the resonance path composed of the first radiation part 110, the second radiation part 120, the third radiation part 130, the fourth radiation part 140, the first shorting element 150, the second shorting element 160, and the surface 104 is operated in two different frequency bands simultaneously. In an embodiment, the resonance path composed of the first radiation part 110, the second radiation part 120, the third radiation part 130, the fourth radiation part 140, the first shorting element 150, the second shorting element 160, and the surface 104 receives and transmits 2.4 GHz and 5 GHz signals, to allow the three-dimensional antenna element 100 to support a dual-frequency band wireless network communication technology.

Figure 4:
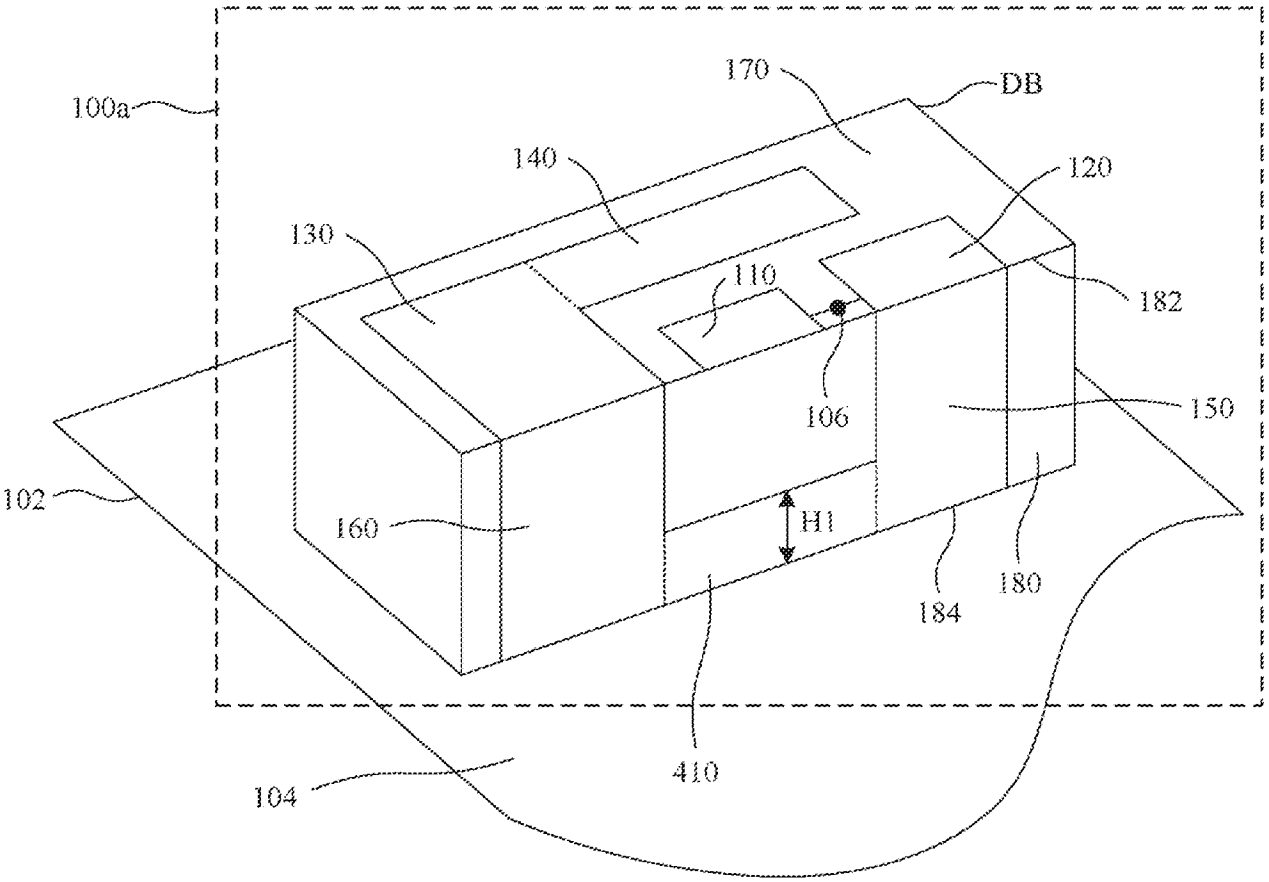
FIG. 4 is a schematic diagram showing a simplified three-dimensional antenna element according to another embodiment of the disclosure.

Refer to FIG. 4. A three-dimensional antenna element 100*a* is similar to the three-dimensional antenna element 100. A difference is that the three-dimensional antenna element 100*a* further includes a third shorting element 410. The third shorting element 410 is disposed on the second plane 180 and connected to the second side 184 of the second plane 180. The third shorting element 410 is further coupled to the first shorting element 150, the second shorting element 160, and the surface 104 of the conductive substrate 102. That is, the first shorting element 150, the second shorting element 160, and the third shorting element 410 jointly form a U-shape connection, and the third shorting element 410 has a first height H1 in a direction perpendicular to the conductive substrate 102.

Figure 5:
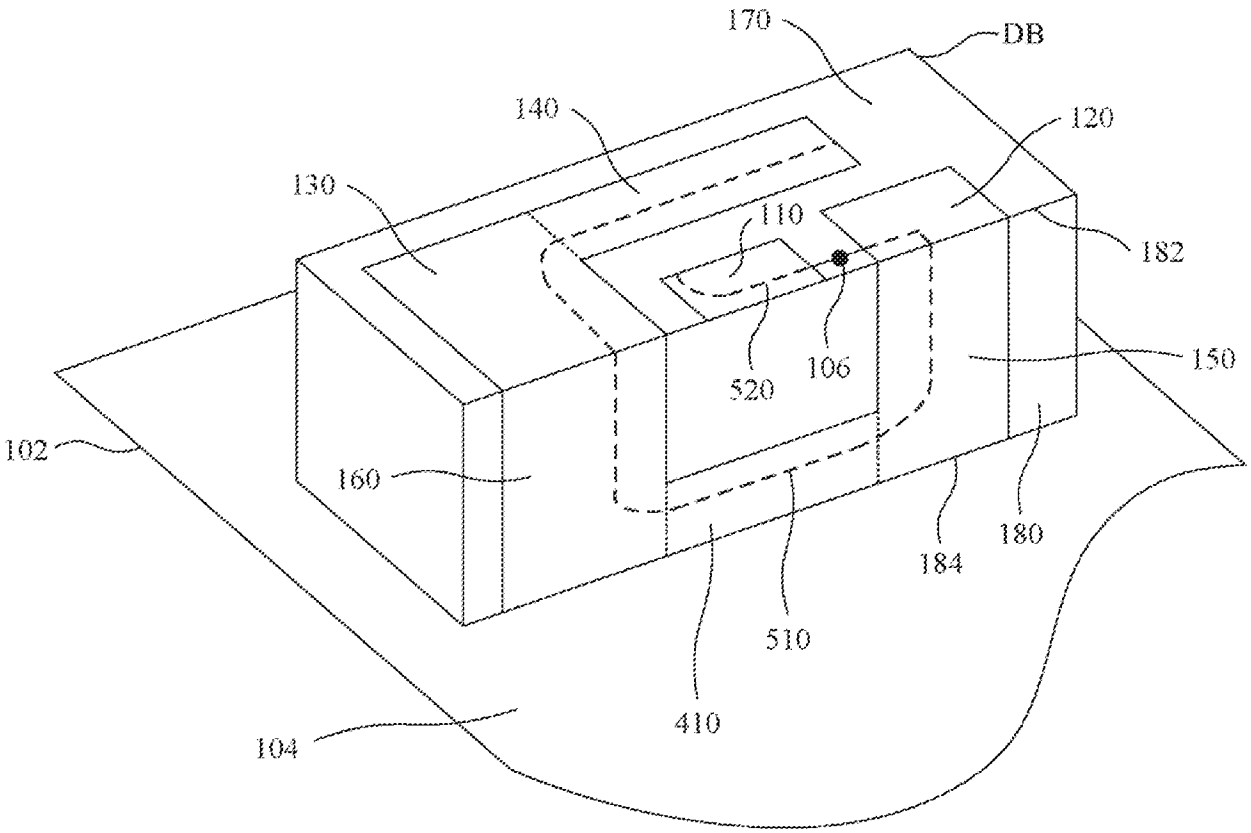
FIG. 5 is a schematic diagram showing a simplified equivalent current path of the three-dimensional antenna element in FIG. 4.

Refer to FIG. 5. When the signal feed-in point 106 of the three-dimensional antenna element 100*a* receives a radio frequency signal, the three-dimensional antenna element 100*a* generates a first equivalent current path 510 and a second equivalent current path 520. The second equivalent current path 520 is similar to the second equivalent current path 320.

The first equivalent current path 510 extends from the signal feed-in point 106 to the fourth radiation part 140 by passing through the second radiation part 120, the first shorting element 150, the third shorting element 410, the second shorting element 160, and the third radiation part 130 in sequence.

The third shorting element 410 is used to adjust a length of the first equivalent current path 510. When the first height H1 decreases, the length of the first equivalent current path 510 increases. Alternatively, when the first height H1 increases, the length of the first equivalent current path 510 decreases. In this embodiment, a resonance frequency of the three-dimensional antenna element 100*a* is in negative correlation with the length of the first equivalent current path 510. Therefore, the resonance frequency of the three-dimensional antenna element 100*a* is in positive correlation with the first height H1.

In other words, with configuration of the third shorting element 410, adjustment flexibility of the resonance frequency of the three-dimensional antenna element 100*a* is improved. Other connection modes, elements, embodiments, and advantages of the three-dimensional antenna element 100 are applicable to the three-dimensional antenna element 100*a* and, for conciseness, are not described herein again.

Figure 6:
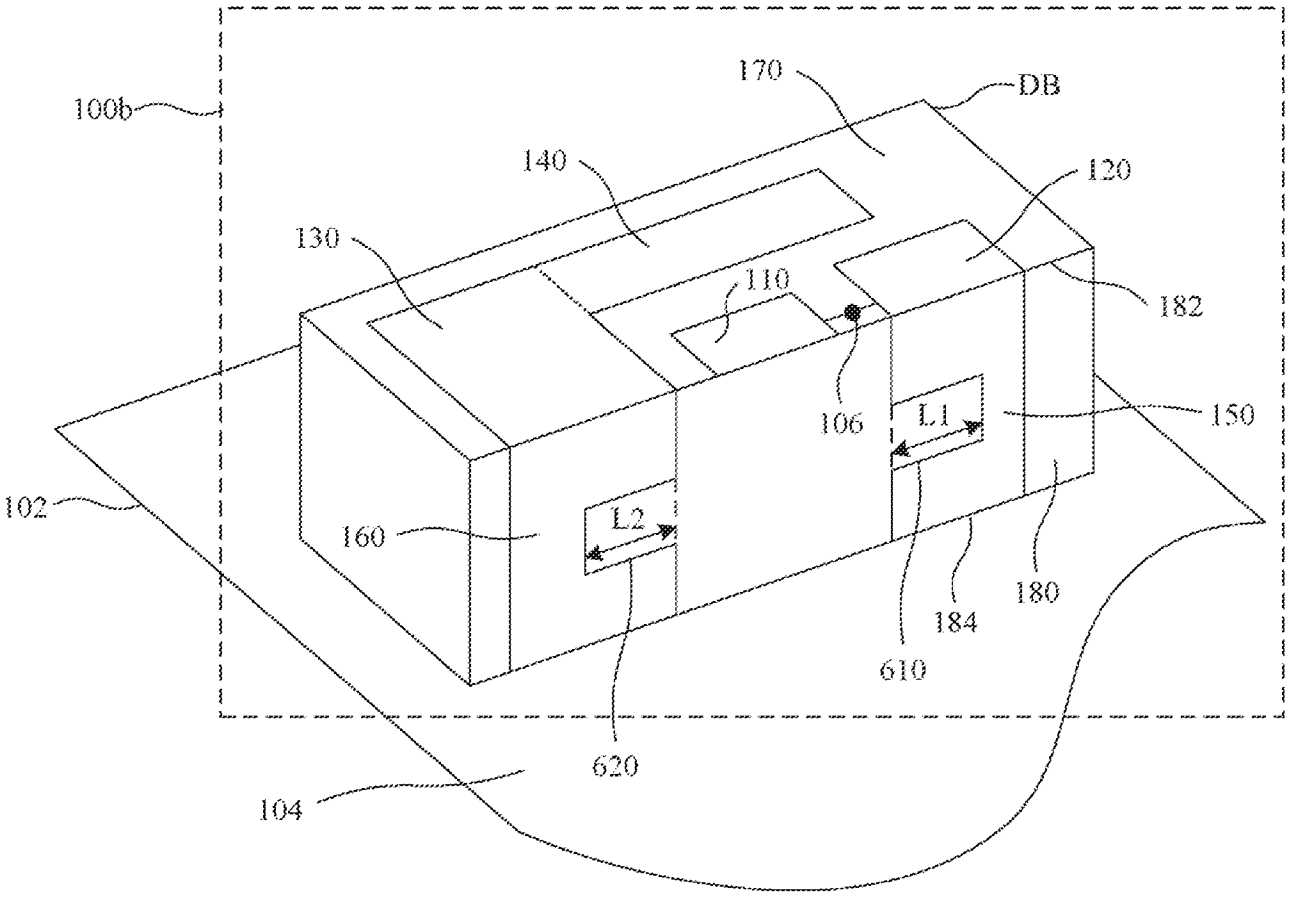
FIG. 6 is a schematic diagram showing a simplified three-dimensional antenna element according to yet another embodiment of the disclosure.

Refer to FIG. 6. A three-dimensional antenna element 100*b* is similar to the three-dimensional antenna element 100. A difference is that the three-dimensional antenna element 100*b* further includes a first slot 610 and a second slot 620. The first slot 610 is disposed on the first shorting element 150 and extending in a direction parallel to the first side 182 or the second side 184. An opening of the first slot 610 faces the second shorting element 160. The second slot 620 is disposed on the second shorting element 160 and extending in a direction parallel to the first side 182 or the second side 184. An opening of the second slot 620 faces the first shorting element 150. That is, the opening of the first slot 610 faces the left of the three-dimensional antenna element 100*b*, and the opening of the second slot 620 faces the right of the three-dimensional antenna element 100*b*. In addition, in a direction parallel to the first side 182 or the second side 184, the first slot 610 has a first length L1, and the second slot 620 has a second length L2.

Figure 7:
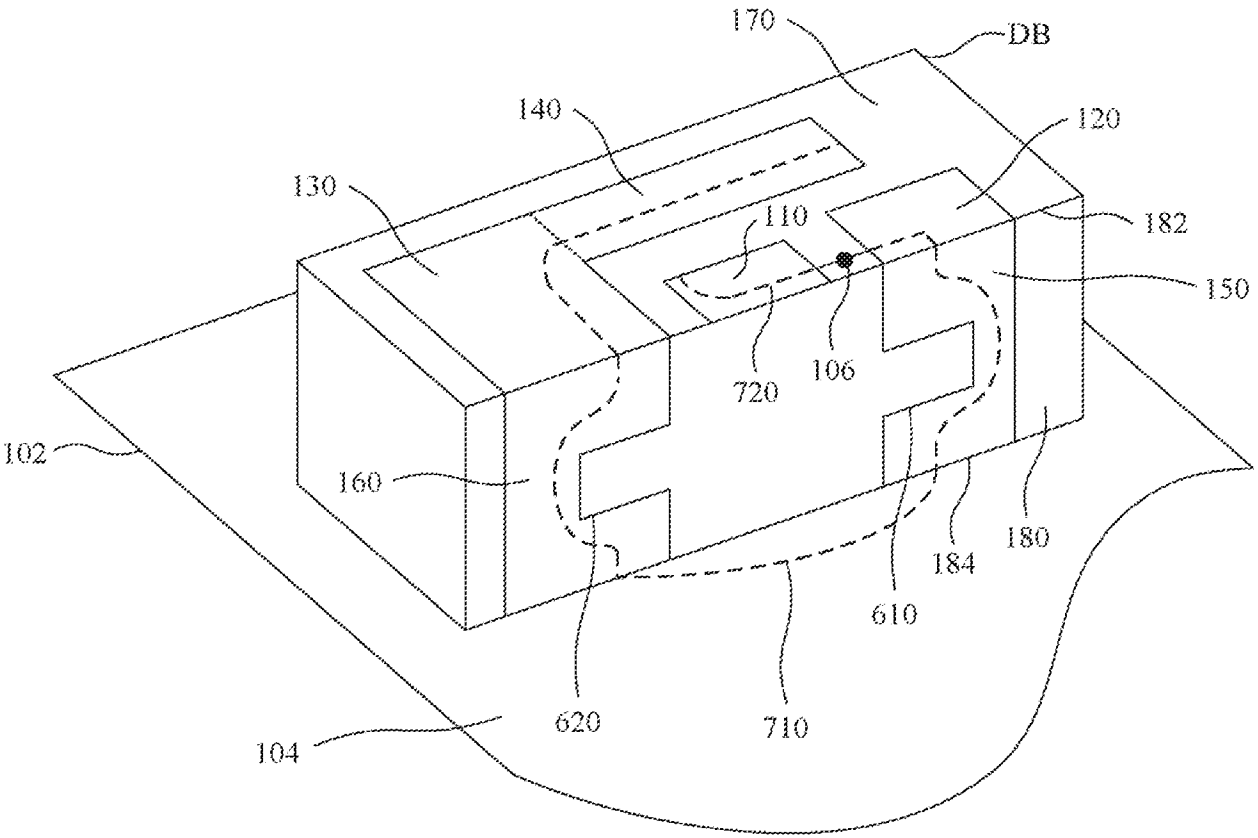
FIG. 7 is a schematic diagram showing a simplified equivalent current path of the three-dimensional antenna element in FIG. 6.

Refer to FIG. 7. When the signal feed-in point 106 of the three-dimensional antenna element 100*b* receives a radio frequency signal, the three-dimensional antenna element 100*b* generates a first equivalent current path 710 and a second equivalent current path 720. The first equivalent current path 710 extends from the signal feed-in point 106 to the fourth radiation part 140 by passing through the second radiation part 120, the first shorting element 150, the surface 104, the second shorting element 160, and the third radiation part 130 in sequence. As shown in FIG. 7, the first slot 610 and the second slot 620 are used to adjust a length of the first equivalent current path 710. That is, the length of the first equivalent current path 710 is in positive correlation with the first length L1 of the first slot 610 and the second length L2 of the second slot 620.

In other words, with configuration of the first slot 610 and the second slot 620, the three-dimensional antenna element 100*b* increases or decreases the length of the first equivalent current path 710 in a case in which a volume is unchanged, to correspondingly decrease or increase a resonance frequency of the three-dimensional antenna element 100*b*.

In an embodiment, the opening of the first slot 610 faces the right of the three-dimensional antenna element 110*b*, and the opening of the second slot 620 faces the left of the three-dimensional antenna element 100*b*. In another embodiment, the openings of the first slot 610 and the second slot 620 both face the left or right of the three-dimensional antenna element 110*b*.

In an embodiment, the three-dimensional antenna element 100*b* includes a plurality of first slots 610 and a plurality of second slots 620. The plurality of first slots 610 are formed in the first shorting element 150, and the plurality of second slots 620 are formed in the second shorting element 160. In this case, the length of the first equivalent current path 710 is in positive correlation with a total quantity of the plurality of first slots 610 and the plurality of second slots 620, and therefore the resonance frequency of the three-dimensional antenna element 100*b* is in negative correlation with the total quantity of the plurality of first slots 610 and the plurality of second slots 620. In addition, lengths and opening directions of the plurality of first slots 610 and the plurality of second slots 620 are respectively adjusted based on different designs. In an embodiment, openings of a part of the plurality of first slots 610 and the plurality of second slots 620 face the left of the three-dimensional antenna device 110*b*, and openings of another part of the plurality of first slots 610 and the plurality of second slots 620 face the right of the three-dimensional antenna element 110*b*.

Figure 8:
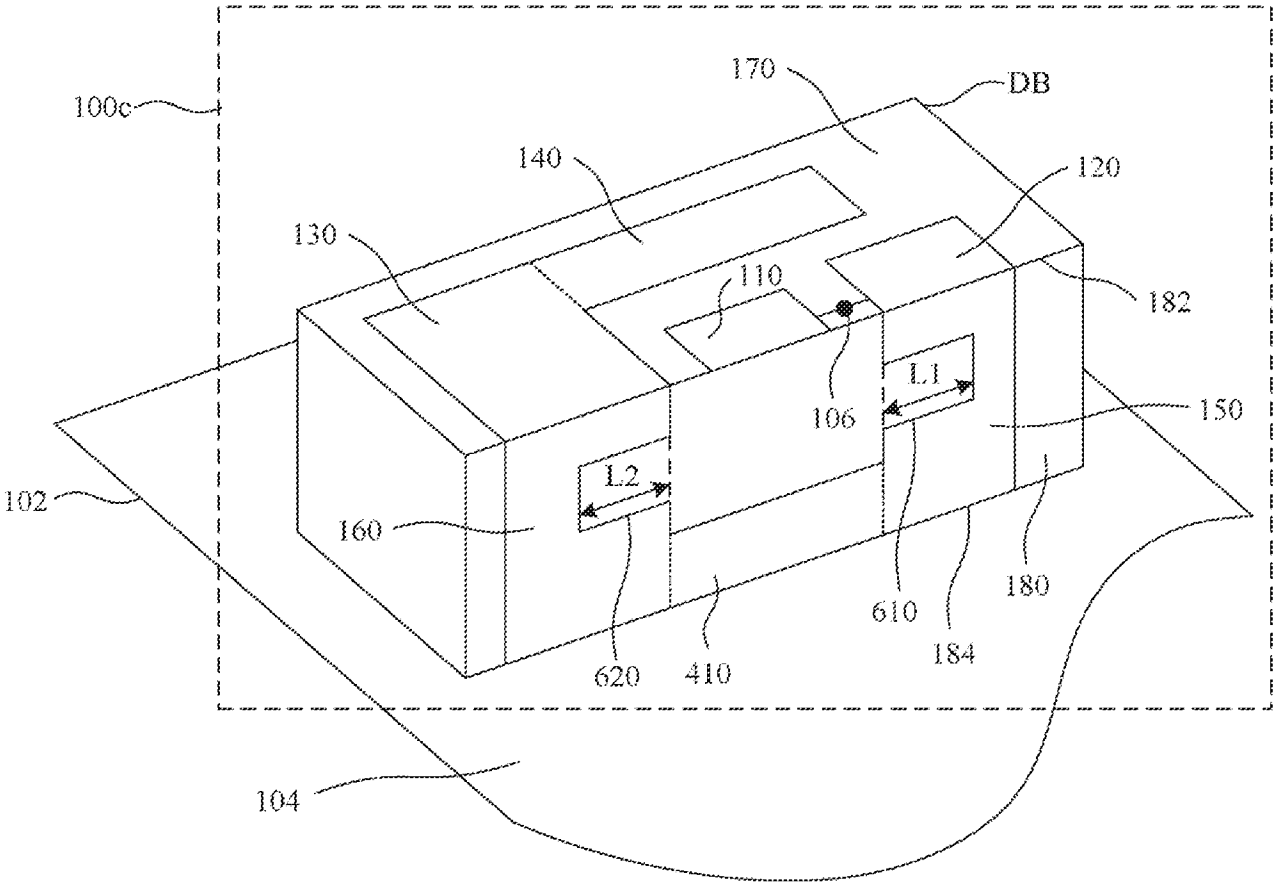
FIG. 8 is a schematic diagram showing a simplified three-dimensional antenna element according to still another embodiment of the disclosure.

Refer to FIG. 8. A three-dimensional antenna element 100*c* is similar to the three-dimensional antenna element 100. A difference is that the three-dimensional antenna element 100*c* further includes the third shorting element 410 in the embodiment in FIG. 4 and the first slot 610 and the second slot 620 in the embodiment in FIG. 6. The third shorting element 410 of the three-dimensional antenna element 100*c* is coupled between the first shorting element 150 and the second shorting element 160. The first slot 610 is disposed on the first shorting element 150. The second slot 620 is disposed on the second shorting element 160. As mentioned above, the third shorting element 410, the first slot 610, and the second slot 620 are used to adjust an equivalent current path of the three-dimensional antenna element 100*c*. Therefore, with configuration of the third shorting element 410, the first slot 610, and the second slot 620, adjustment flexibility of the resonance frequency of the three-dimensional antenna 110*c* is improved.

In an embodiment, the three-dimensional antenna element 100*c* includes a plurality of first slots 610 and a plurality of second slots 620. Other connection modes, elements, embodiments, and advantages of the three-dimensional antenna element 100 are applicable to the three-dimensional antenna element 100*c* and, and for conciseness, are not described herein again.

It is to be learned from the above that equivalent current paths of the three-dimensional antenna elements 100, 110*a*, 110*b*, and 110*c* have a plurality of different flow directions, allowing generation of a radiation pattern in which energy of horizontal polarization and energy of vertical polarization are approximately balanced. In an embodiment, current flow directions of the first radiation part 110, the second radiation part 120, the fourth radiation part 140, and the surface 104 of the dielectric base are parallel to a first coordinate axis, a current flow direction of the third radiation part 130 is parallel to a second coordinate axis, current flow directions of the first shorting element 150 and the second shorting element 160 are parallel to a third coordinate axis, and the first coordinate axis, the second coordinate axis, and the third coordinate axis are different from each other.

Therefore, the three-dimensional antenna elements 100, 110*a*, 110*b*, and 110*c* are configurable in a mobile communication device with a full-metal body and are applicable to a wireless communication environment having a plurality of signal paths.

In the specification and claims of the disclosure, some terms are used to represent specific elements. However, persons having common knowledge in the technical field should understand that a same element is sometimes called by using different names. In the specification and claims of the disclosure, elements are not differentiated by means of differences of names, and the differentiation of the elements is based on differences of functions. "Include/comprise" mentioned in the specification and claims of the disclosure are open words, and therefore, should be explained as "include/comprise but not limited".

The description manner of "and/or" used herein includes one of multiple items or any combination of the multiple items listed. In addition, unless specially stated in the specification, any words in singular forms include plural meanings.

In the specification and claims of the disclosure, if a first element is located on a second element, located above the second element, connected to, joined to, coupled to the second element or in direct connection with the second element in descriptions, it indicates that the first element is directly located on the second element, directly connected to, directly joined to or directly coupled to the second element, or indicates that there is another element between the first element and the second element. Comparatively, if the first element is directly located on the second element, or directly connected to, directly joined to, directly coupled to or in direct connection with the second element in descriptions, it indicates that there are no other elements between the first element and the second element.

The above descriptions are merely preferred embodiments of the disclosure, and any equivalent changes or modifications made according to the claims of the disclosure fall within the scope of the disclosure.

What is claimed is:

1. A three-dimensional antenna element, disposed on a surface of a conductive substrate, wherein the three-dimensional antenna element comprises:

a dielectric base, comprising a first plane and a second plane, wherein the second plane comprises:

a first side; and a second side, opposite to the first side; wherein the first side is connected to the first plane, and the second side is connected to the surface of the conductive substrate;

a first radiation part;

a second radiation part, wherein a signal feed-in point is coupled between the first radiation part and the second radiation part;

a third radiation part, wherein the first radiation part, the second radiation part, and the third radiation part are disposed on the first plane and are connected to the first side of the second plane;

a fourth radiation part, disposed on the first plane and coupled to the third radiation part;

a first shorting element, disposed on the second plane and coupled between the second radiation part and the surface of the conductive substrate; and a second shorting element, disposed on the second plane and coupled between the third radiation part and the surface of the conductive substrate.

2. The three-dimensional antenna element according to claim 1, wherein the first plane is parallel to the conductive substrate, and the second plane is perpendicular to the first plane and the conductive substrate, so that a first equivalent current path passing through at least one of the first radiation part, the second radiation part, the third radiation part, the fourth radiation part, the first shorting element, the second shorting element, or the surface of the conductive substrate has a plurality of flow directions.

3. The three-dimensional antenna element according to claim 1, wherein the third radiation part comprises:

a first end; and a second end, opposite to the first end and connected to the first side of the second plane;

wherein the fourth radiation part is coupled to the first end of the third radiation part and is in L-shape connection with the third radiation part.

4. The three-dimensional antenna element according to claim 3, wherein a first distance is between the first radiation part and the third radiation part, and a second distance is between the first radiation part and the fourth radiation part.

5. The three-dimensional antenna element according to claim 4, wherein the second radiation part, the third radiation part, the fourth radiation part, and the first side of the second plane are around the first radiation part.

6. The three-dimensional antenna element according to claim 3, wherein the first radiation part extends from the signal feed-in point to the third radiation part, the fourth radiation part extends outwards from the first end of the third radiation part, and the first radiation part, the fourth radiation part, and the first side of the second plane are parallel to each other.

7. The three-dimensional antenna element according to claim 1, further comprising:

a third shorting element, disposed on the second plane, connected to the second side of the second plane, and coupled to the first shorting element, the second shorting element, and the surface of the conductive substrate.

8. The three-dimensional antenna element according to claim 7, wherein the third shorting element has a first height in a direction perpendicular to the conductive substrate, and a resonance frequency of the three-dimensional antenna element is in positive correlation with the first height.

9. The three-dimensional antenna element according to claim 7, wherein the first shorting element, the second shorting element, and the third shorting element are in U-shape connection.

10. The three-dimensional antenna element according to claim 1, wherein the first shorting element comprises at least one first slot, and the second shorting element comprises at least one second slot.

11. The three-dimensional antenna element according to claim 10, wherein the first shorting element comprises a plurality of first slots, and the second shorting element comprises a plurality of second slots.

12. The three-dimensional antenna element according to claim 11, wherein a resonance frequency of the three-dimensional antenna element is in negative correlation with a total quantity of the plurality of first slots and the plurality of second slots.

* * * * *